US006155846A

United States Patent [19]

Yeoh et al.

[11] Patent Number: 6,155,846

[45] Date of Patent: Dec. 5, 2000

[54] ELECTRICAL CONTACTOR ASSEMBLY

[75] Inventors: Pit Yeow Yeoh; Wei Wei Ong; Chin Chin Ooi, all of Penang; Soo Yong Tan, Bukit Mertajam, all of Malaysia

[73] Assignee: Motorola, Inc., Schaumburg, Ill.

[21] Appl. No.: 09/476,533

[22] Filed: Jan. 3, 2000

[51] Int. Cl.[7] ..... H01R 11/18; H01R 13/00

[52] U.S. Cl. ..... 439/95; 439/482

[58] Field of Search ..... 439/483, 700, 439/824, 78, 84, 81, 869, 387, 389, 482, 819, 843, 839, 844

[56] References Cited

U.S. PATENT DOCUMENTS

| | | | |
|---|---|---|---|
| 4,773,877 | 9/1988 | Krüger et al. | 439/482 |
| 4,897,043 | 1/1990 | Giringer et al. | 439/482 |
| 5,333,978 | 8/1994 | Rives | 411/389 |
| 5,540,531 | 7/1996 | Choiniere | 411/387 |
| 5,749,754 | 5/1998 | Patterson et al. | 439/824 |
| 5,921,803 | 7/1999 | Mori | 439/387 |
| 6,024,600 | 2/2000 | Daoud et al. | 439/540.1 |

*Primary Examiner*—Renee Luebke
*Assistant Examiner*—Phuongchi Nguyen
*Attorney, Agent, or Firm*—Barbara R. Doutre

[57] ABSTRACT

An electrical contactor assembly (10) has a conductive body (11) with an external thread (12). An electrical contact (14) is electrically coupled via a conductive spring (25) to body (11). A housing (16) is attached to body (11) and has an opening (27) to allow protrusion of an elongate cylindrical conductor (24) of electrical contact (14) having a contact surface (15). An abutment (26) of elongate cylindrical conductor (24) abuts housing (16) for captive location therein and to retain electrical contact (14) in a bore (31) in body (11) against the biasing influence of spring (25). External thread (12) is self-tapping and can be self-drilling.

12 Claims, 4 Drawing Sheets

ELECTRICAL CONTACTOR ASSEMBLY

FIELD OF THE INVENTION

This invention relates to an electrical contactor assembly by which to effect electrical contact with circuit components of electrical and electronic devices. In particular, this invention relates to an electrical contactor assembly that is fitted with a threaded end for screwed engagement to a mounting surface therefor.

BACKGROUND OF THE INVENTION

Contactors for electrically connecting to circuit components of electronic devices are known in a variety of forms. One class of contactor is designed to enable convenient connection to a circuit component without requiring an additional process such as soldering. Such a contactor is typically used when a circuit component needs to be changed occasionally such as, for example, when a battery is to be replaced because its stored energy is low or depleted.

Conventionally, a contactor of the above type has a conductive contact to electrically contact an electrode of a circuit component. A simple form of a mountable contactor may be a rivet head but this is not able to maintain a reliable contact in all circumstances. An improvement over such rigid contactors employs a resilient contact such as a leaf spring to accommodate variations in the size or the position of a circuit component and also to maintain constant electrical contact to that circuit component under conditions such as a jolt that might break the contact.

Battery connectors provide one example of contactors in which contacts are typically resiliently formed or biassed. An example of a biassed type contactor is described in U.S. Pat. No. 4,897,043 in which a contact end of a contact pin is urged by a spring in a forward direction relative to a metallic tube.

Contactors of the above-described biassed kind usually comprise a number of elements assembled together with some means by which they are mounted.

Leaf spring contactors suffer from fatigue in the resilient contact and electrical contact can be lost after a degree of fatigue.

A separately biassed contact, usually a contact pin acted on by a coil spring, is less prone to fatigue so long as a substantial coil spring is used. Overall, the dimensions of the biassed contact pin type of electrical connector are considerable and the techniques by which they are fixed in place are not always convenient.

SUMMARY OF THE INVENTION

The invention provides in a first form an electrical contactor assembly that includes:

- an electrically conductive screw threaded body mountable, in use, to a substrate by screw threaded engagement therewith;
- a housing releasably engagable with said screw threaded body; and,
- an electrically conductive contact element captively secured to said screw threaded body by said housing, said contact element being electrically coupled to said screw threaded body and extending at least partially from an aperture in said housing.

Suitably the screw threaded body has a self tapping thread formed on an outer surface thereof adjacent one end of said body.

The screw threaded body may be formed with a self drilling tip.

Preferably the electrical contactor assembly includes a mounting tool engager.

The mounting tool engager may include at least one engagement face.

Suitably the mounting tool engager is formed on said screw threaded body.

Alternatively the mounting tool engager is formed on said housing.

The housing may be releasably engagable with said body by screw threaded engagement therewith.

Suitably the housing is releasably engagable with said body by at least one radially directed socket and spigot connector.

Suitably the contact element has a resilient mounting in said housing.

Preferably the resilient mounting comprises a helical spring biasing said contact element in an axially outward direction.

BRIEF DESCRIPTION OF THE DRAWINGS

In order to describe the invention and to put it into practical effect, reference will now be made to various preferred embodiments of the invention as illustrated with reference to the accompanying drawings in which.

DETAILED DESCRIPTION OF THE DRAWINGS

Figure 1:
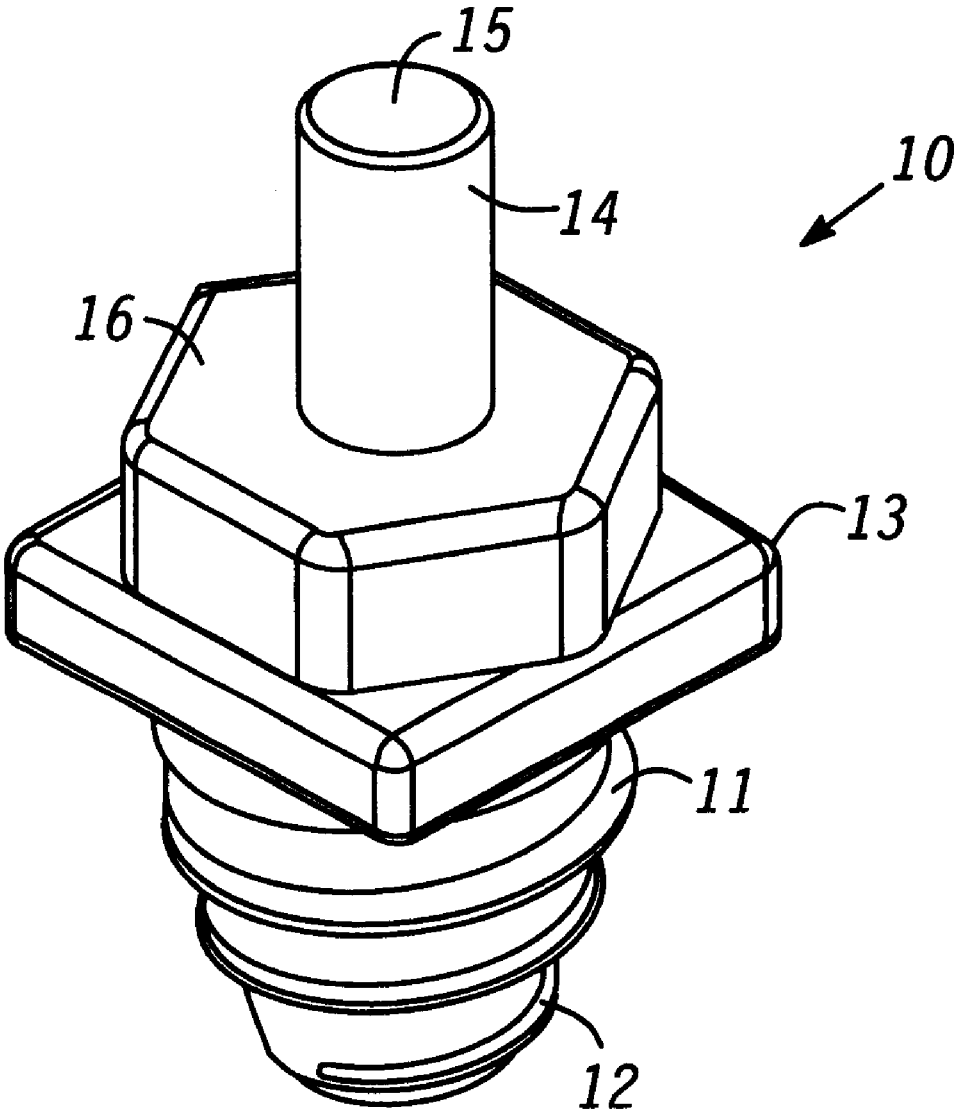
FIG. 1 is a perspective view of an electrical contactor assembly in accordance with a preferred embodiment of the invention.

In FIG. 1, is seen a perspective view of an electrical contactor assembly 10 with an electrically conductive screw threaded body 11 forming a mount for the assembly with an external thread 12 effective as a self tapping thread able to be screwed into a substrate (not shown). Body 11 is fitted, in this embodiment, with a mounting tool engager in the form of a flange 13 and releasable housing 16 that are configured for engagement with a mounting tool by which to spin the electrical connector into a substrate. Electrical contactor assembly 10 can be screwed into place until firmly abutted at flange 13, either or both the flange and body 11 effecting an electrical connection of electrical contactor assembly 10 as required. Flange 13 may be used for both the mounting of electrical contactor assembly 10 and its dismounting from a substrate depending on how housing 16 (described in greater detail below) is fitted.

Housing 16 may be a screwed attachment to body 11 and whilst it may be used to drive electrical contactor assembly 10 at installation, flange 13 will be needed, in this variation, to remove electrical contactor assembly 10.

The substrate to which electrical contactor assembly 10 is applied, in use, can be, for example, a housing for an electronic device, or a casing for a component of the device, such as a battery case. Alternatively, the substrate may be a particular fixture within an electronic device at which an electrical contact is desired. It will be clear to those skilled in the art that a substrate includes common cast metal boxes used to house circuitry, or other material substrates with a conductive coating with which to contact flange 13 to effect a requisite electrical contact when flange 13 is formed integrally with body 11.

In FIG. 1 the electrical contactor assembly 10 comprises, in this embodiment, an electrical contact element 14 having a contact surface 15 for electrically contacting circuit components. Electrical contact element 14 projects from housing 16 which is effective to captively secure at least some portion of electrical contact element 14 within body 11.

Figure 2:
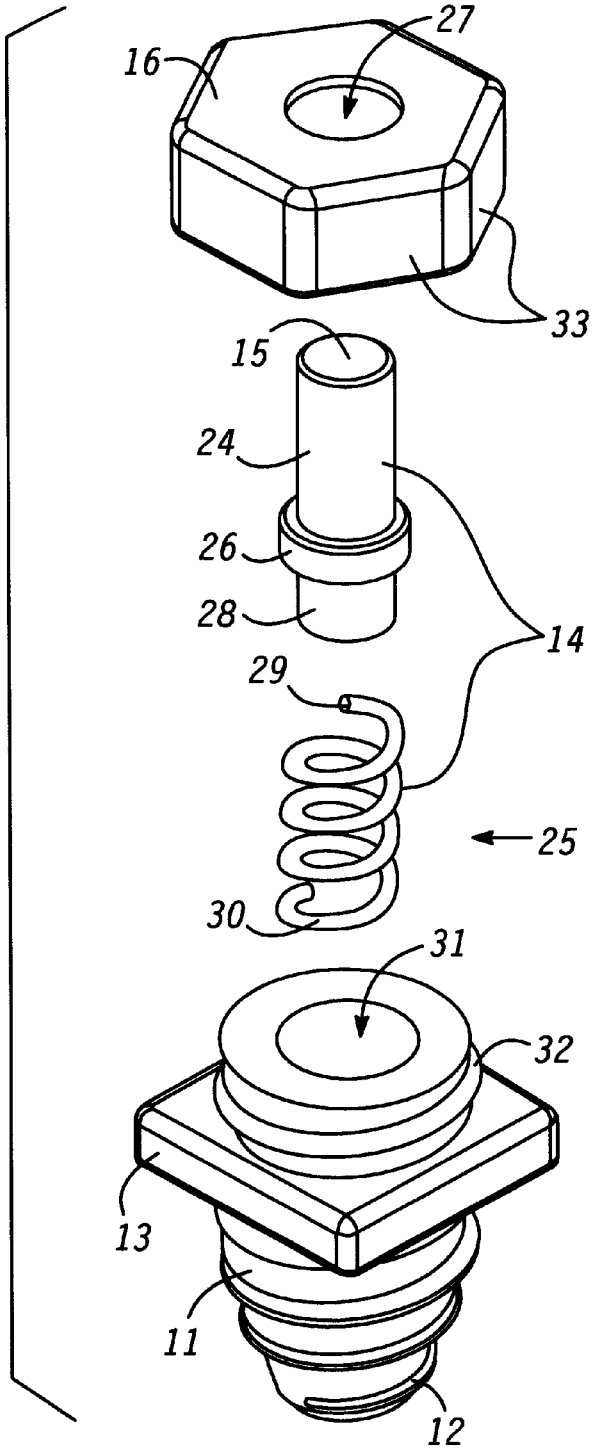
FIG. 2 is an exploded perspective view of the electrical contactor assembly of FIG. 1.

In FIG. 2 is seen an exploded view of electrical contactor assembly 10 wherein flange 13 extends radially outwardly from body 11. In this embodiment, flange 13 has a perimeter with four substantially linear edges. However, as is known in the art, only one linear edge is sufficient to enable a mounting tool such as, for example, an adjustable wrench or spanner to engage flange 13.

Electrical contact element 14 is an elongate cylindrical conductor 24 and it is biassed by a helical conductive spring 25. Elongate cylindrical conductor 24 can be fitted with an abutment 26 to both abut housing 16 and to provide a shoulder for spring 25 to engage. Abutment 26 captively retains elongate cylindrical conductor 24 in an opening 27 of housing 16. The opposite end of elongate cylindrical conductor 24, portion 28, is distal to contact surface 15 and it locates within the coils of spring 25 to establish electrical contact with an end 29 of conductive spring 25.

Spring 25 both electrically couples to elongate cylindrical conductor 24 and resiliently biases it by compression against abutment 26 such that contact surface 15 is urged, in use, against an electrode of a circuit component (not shown) to effect electrical connection with the circuit component. An opposite conductive end 30 of spring 25 is electrically coupled by engagement in the base of bore 31 in body 11.

Also seen in FIG. 2 is a housing engagement portion 32 above flange 13 on body 11, housing engagement portion 32 also being externally threaded. This allows internal threads (not shown) of housing 16 to engage housing engagement portion 32. Housing 16 is shaped to accommodate a driver for mounting of electrical contactor assembly 10 to a substrate. As shown, the shape might be that of an hexagonal nut with faces 33. Spring 25 can therefore be retained within bore 31 when housing 16 engages housing engagement portion 32, without the need for any special mounting.

Figure 3:
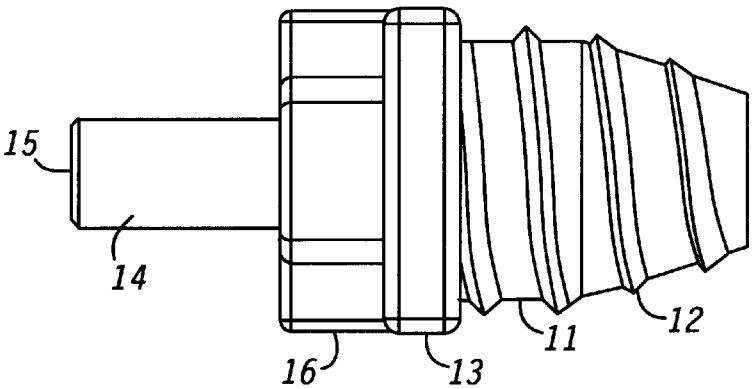
FIG. 3 is a side view showing an externally threaded end of the electrical contactor assembly of FIG. 1.

Advantageously, as shown in FIG. 3, the portion of body 11 incorporating thread 12 is tapered to assist in mounting to a substrate.

Figure 4:
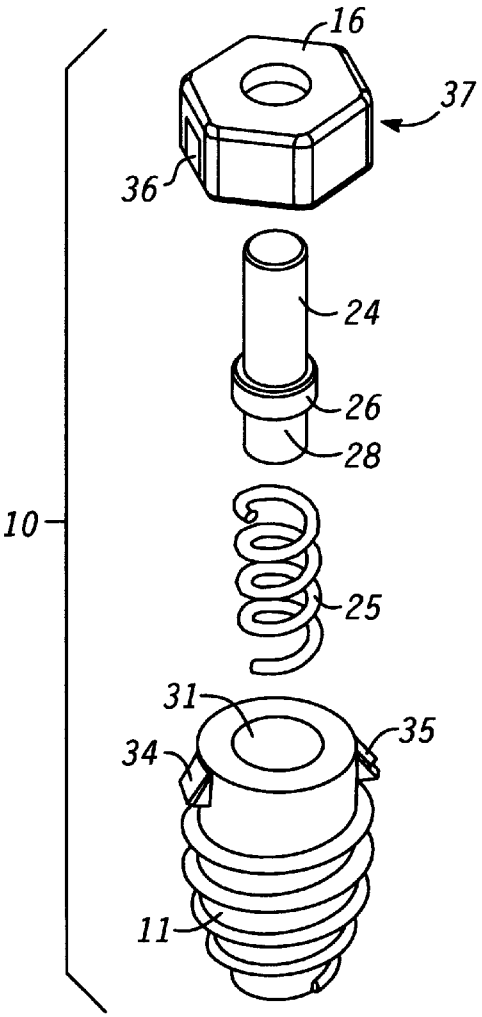
FIG. 4 is an exploded perspective view of a further embodiment of the invention.

In FIG. 4 is seen another form of the invention in which like components bear like reference numerals. In this embodiment body 11 has opposed radially directed tapered projections 34, 35. These provide a tapered face over which housing 16 might be pushed with projections 34, 35 extending out through openings 36, 37 to effect a socket and spigot like engagement of housing 16 to body 11. The socket and spigot like engagement resists rotation of housing 16 relative to body 11 so that housing 16 can be engaged by a driver to mount or demount electrical contactor assembly.

Figure 5:
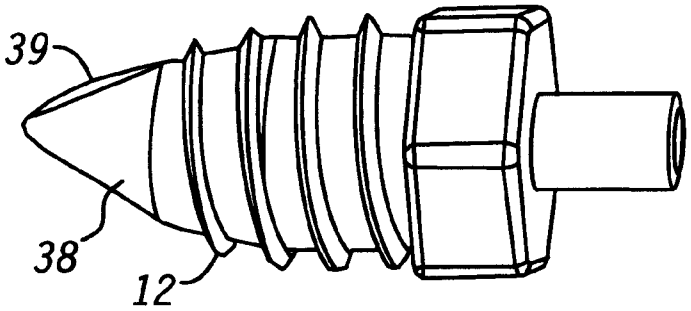
FIG. 5 is a side perspective view of yet a further embodiment of the invention.

In FIG. 5 is seen an electrical contactor assembly which may include the above described variations with a screw thread 12 extended from a self-drilling tip 38 having a cutting edge 39. The particular features of a self-drilling tip for a self-tapping screw are well known to those skilled in the art and their variety of forms might be used in the present electrical contactor assembly.

Figure 6:
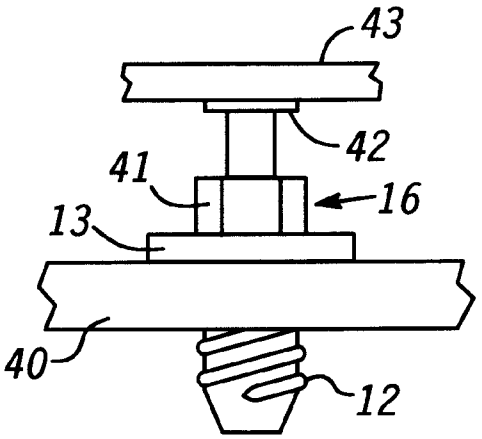
FIG. 6 is a side elevation of an electrical contactor assembly mounted to a substrate in accordance with the invention.

In FIG. 6 is seen electrical contactor assembly 10 mounted to a substrate 40 and electrically coupled to an electrical contact 42 such as a solder pad on a circuit board 43. A suitable driver might engage with driver engagement faces such as face 41 on housing 16 to spin electrical contactor assembly 10 into place with thread 12 pulling flange 13 onto substrate 40. Electrical coupling may thus be achieved with the substrate 40 and/or circuitry on the substrate by mechanical connection between screw thread 12 and substrate 40 and/or engagement between flange 13 and an upper surface of substrate 40. Substrate 40 is typically a conductive chassis or housing for an electronic device. As is illustrated for the above described embodiments, housing 16 is conveniently of a hexagonal form to enable any of the standard drivers to be used, as will be clear to those skilled in the art, and driven ideally by a powered tool (not shown).

An installer can mount an electrical contactor assembly by use of a suitable tool to rotate it. Furthermore, the self-tapping feature provides a more effective electrical connection in a bore of a conductive substrate. The self-tapping conductive body might be adapted with a self-drilling tip. Advantageously the electrical contactor assembly can be readily de-mounted when the requisite means are provided by which to rotate oppositely. The electrical contact can simply be just a resilient conductive pin, extended from the housing, effecting a biassed contact with a circuit component. The primary character of the invention is the more effective installation possibilities and this can be realized for a variety of contact types.

The above-described self-tapping contactor assembly allows application by simply screwing it into its substrate. The thread on the body adds rigidity to the body and it assists in maintaining good electrical contact with the substrate. The self-tapping contactor assembly is particularly useful during servicing when it is simple matter to unscrew the electrical contactor assembly as opposed to other riveted and soldered structures. The combination of a threaded body and an enclosed spring biasing the contact is particularly useful in maintaining electrical contact with a circuit component where pressure is needed to hold contact during adverse events such as a jolt working against the contact. Enclosing the spring within the body is particularly useful in reducing the dimensions of a device using the contactor assembly whilst retaining a good length of coil spring. A coil spring is advantageous in so far as it suffers less from fatigue ensuring better long term integrity of the contact. As stated above the body can conveniently accommodate the spring therein as being hollow is not a disadvantage because the addition of a thread can make up for some loss of rigidity resulting from the bore in the body.

What is claimed is:

1. An electrical contactor assembly electrically coupled to an electrical contact of an electronic device, said contactor assembly comprising:

an electrically conductive screw threaded body mountable, in use, to a substrate by screw threaded engagement therewith;

a housing releasably engagable with said screw threaded body; and an electrically conductive contact element captively secured to said screw threaded body by said housing, said contact element being electrically coupled to said screw threaded body and extending at least partially from an aperture in said housing;

said screw threaded body being threadably engaged and electrically coupled with a substrate and wherein said contact element is urged against said electrical contact by a biasing force.

2. An electrical contactor assembly including:

an electrically conductive screw threaded body mountable, in use, to a substrate by screw threaded engagement therewith;

a housing releasably engagable with said screw threaded body; and, an electrically conductive contact element captively secured to said screw threaded body by said housing, said contact element being electrically coupled to said screw threaded body and extending at least partially from an aperture in said housing.

3. A contactor assembly as claimed in claim 1 wherein the housing is releasably engagable with said body by screw threaded engagement therewith.

4. A contactor assembly as claimed in claim 1 wherein the housing is releasably engagable with said body by at least one radially directed socket and spigot connector.

5. A contactor assembly as claimed in claim 1, wherein the screw threaded body has a self-tapping thread formed on an outer surface thereof adjacent one end of said body.

6. A contactor assembly as claimed in claim 5, wherein the screw threaded body is formed with a self-drilling tip.

7. A contactor assembly as claimed in claim 1 wherein said contact element has a resilient mounting in said housing.

8. A contactor assembly as claimed in claim 7 wherein said resilient mounting comprises a helical spring biasing said contact element in an axially outward direction.

9. A contactor assembly as claimed in claim 1 further including a mounting tool engager.

10. A contactor assembly as claimed in claim 9 wherein the mounting tool engager includes at least one engagement face.

11. A contactor assembly as claimed in claim 10 wherein the mounting tool engager is formed on said screw threaded body.

12. A contactor assembly as claimed in claim 10 wherein the mounting tool engager is formed on said housing.

* * * * *